US006290366B1

(12) United States Patent
Lin

(10) Patent No.: US 6,290,366 B1
(45) Date of Patent: Sep. 18, 2001

(54) POLYGONAL RATCHET WRENCH WITH AN ILLUMINATING DEVICE

(76) Inventor: Wan-Chang Lin, No. 3, Industrial 15th Rd., Ta-Li Industrial Zone, Taiping City, Taichung (TW)

( * ) Notice: Subject to any disclaimer, the term of this patent is extended or adjusted under 35 U.S.C. 154(b) by 0 days.

(21) Appl. No.: 09/498,212

(22) Filed: Feb. 4, 2000

(51) Int. Cl.[7] ..... B25B 23/18
(52) U.S. Cl. ..... 362/119; 362/109
(58) Field of Search ..... 362/109, 119, 362/120, 253

(56) References Cited

U.S. PATENT DOCUMENTS 4,324,158 * 4/1982 Le Roy ..... 81/60
5,848,832 * 12/1998 Hsich ..... 362/119
5,897,198 * 4/1999 Hsich ..... 362/119
6,116,746 * 9/2000 Hsu ..... 362/119

* cited by examiner

*Primary Examiner*—Sandra O'Shea
*Assistant Examiner*—John Anthony Ward
(74) *Attorney, Agent, or Firm*—Jiawei Huang; J. C. Patents

(57) ABSTRACT

A polygonal ratchet wrench with an illuminating device including a hollow housing and a matching body is characterized on that: the hollow housing has interior positive leads, negative leads and batteries for forming a complete power supply unit, and lamps for illuminating the working area as well as the object therein are constructed at a bottom of the matching body and the bottom of the hollow housing. By providing a receiving hole of the matching body, a labor-saving extension bar can be engaged for extending the force arm of the polygonal ratchet wrench.

6 Claims, 9 Drawing Sheets

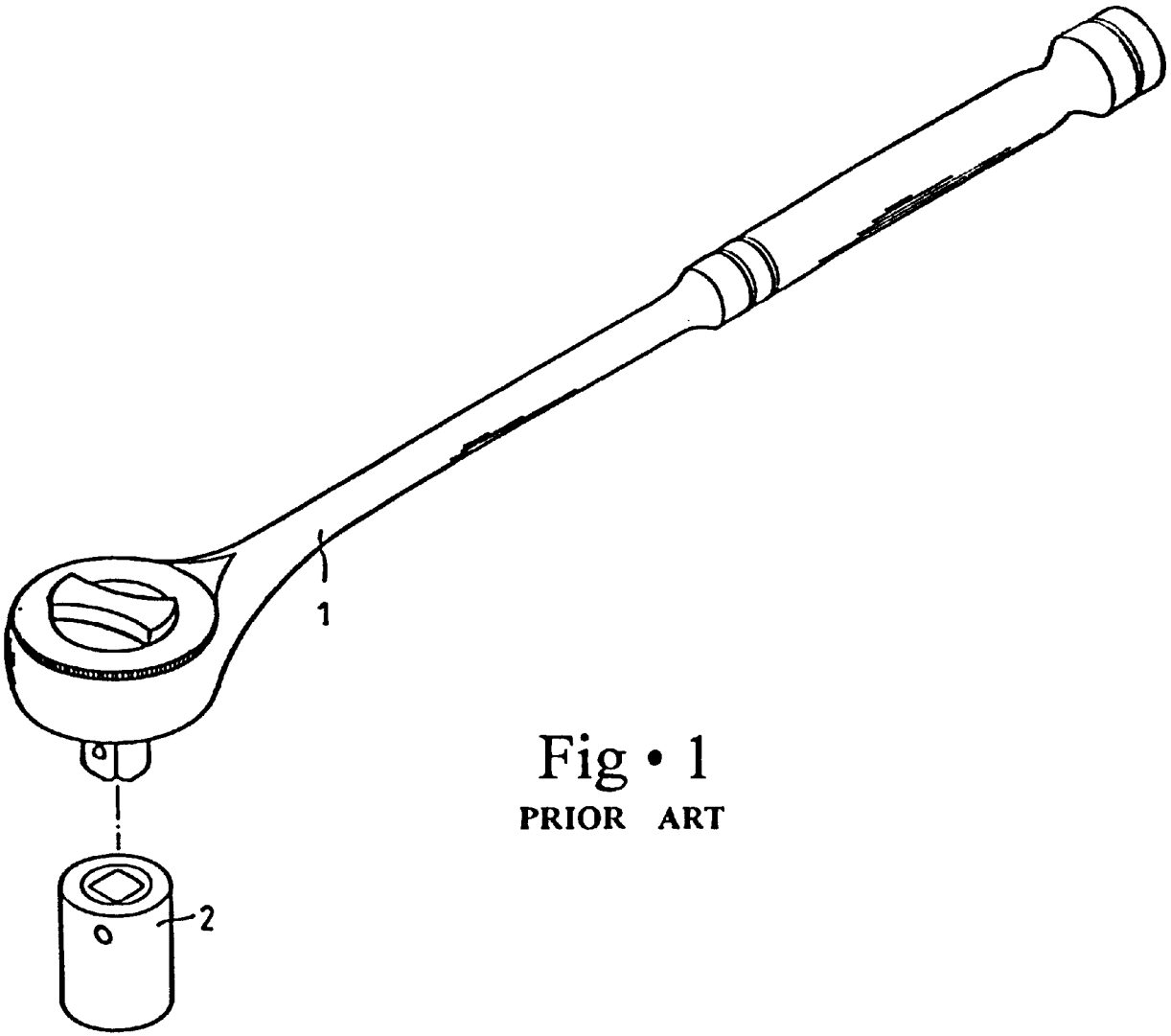
Fig • 1
PRIOR ART

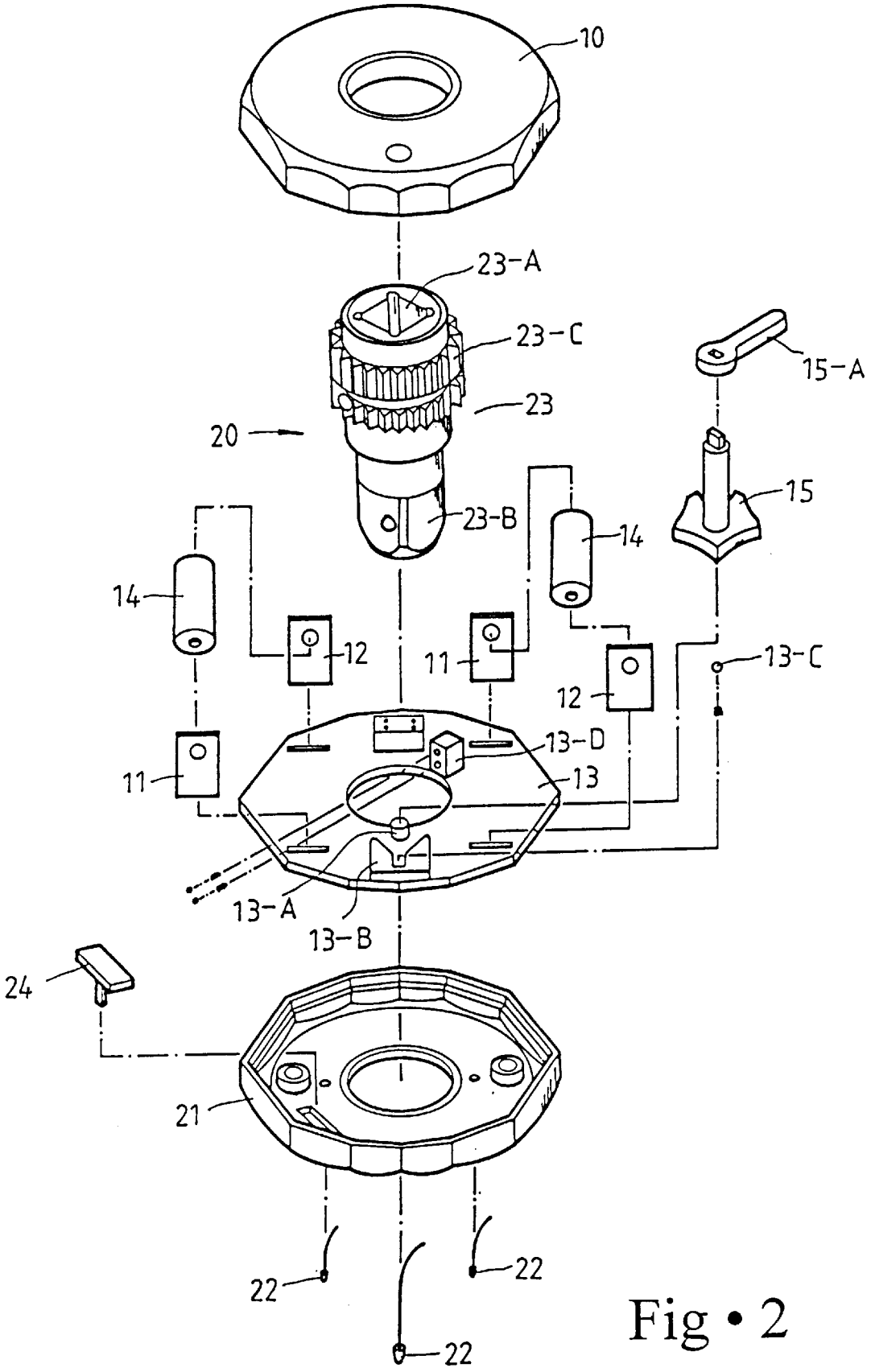
Fig • 2

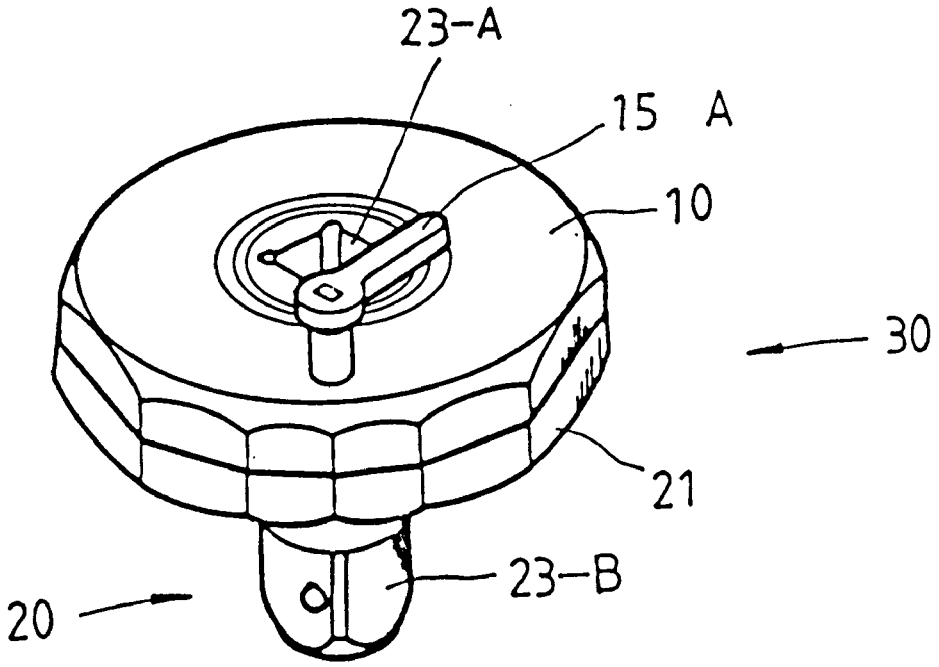
Fig • 3

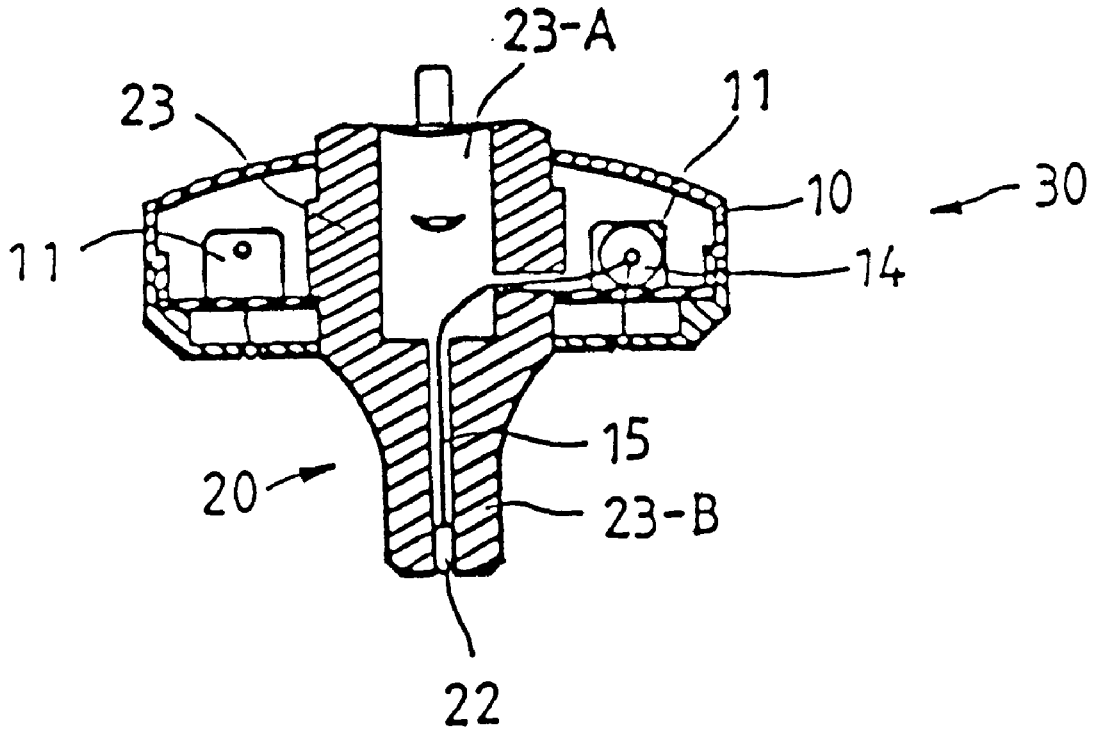
Fig • 4

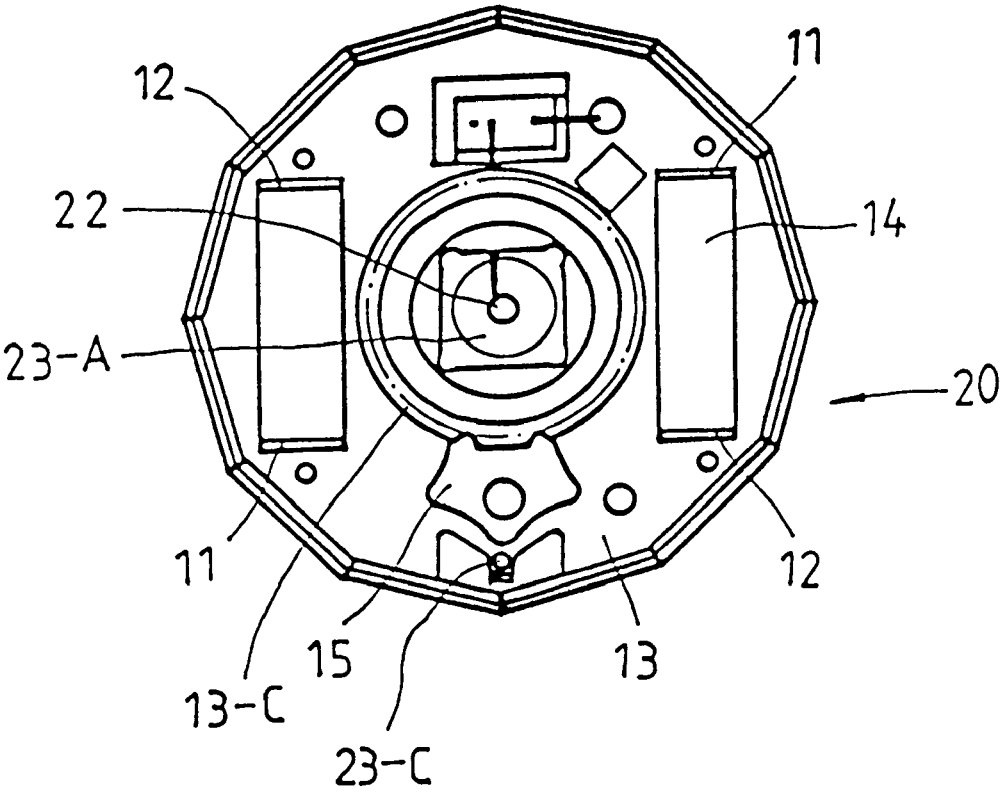
Fig • 5

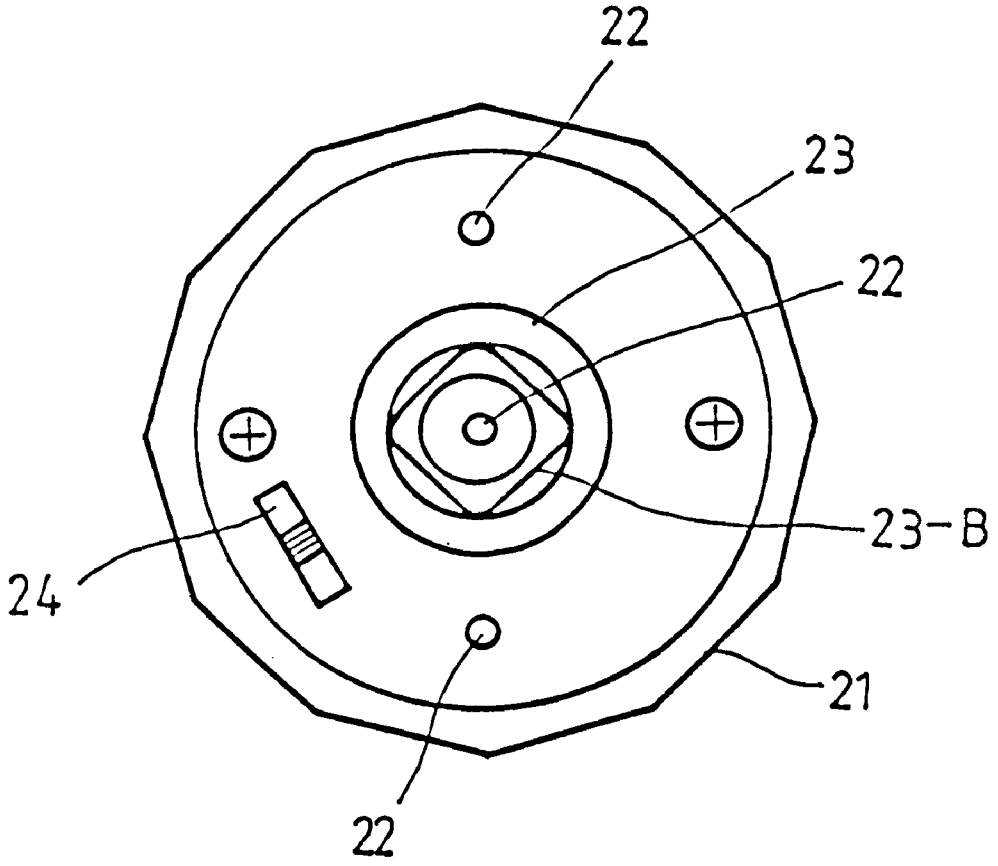
Fig • 6

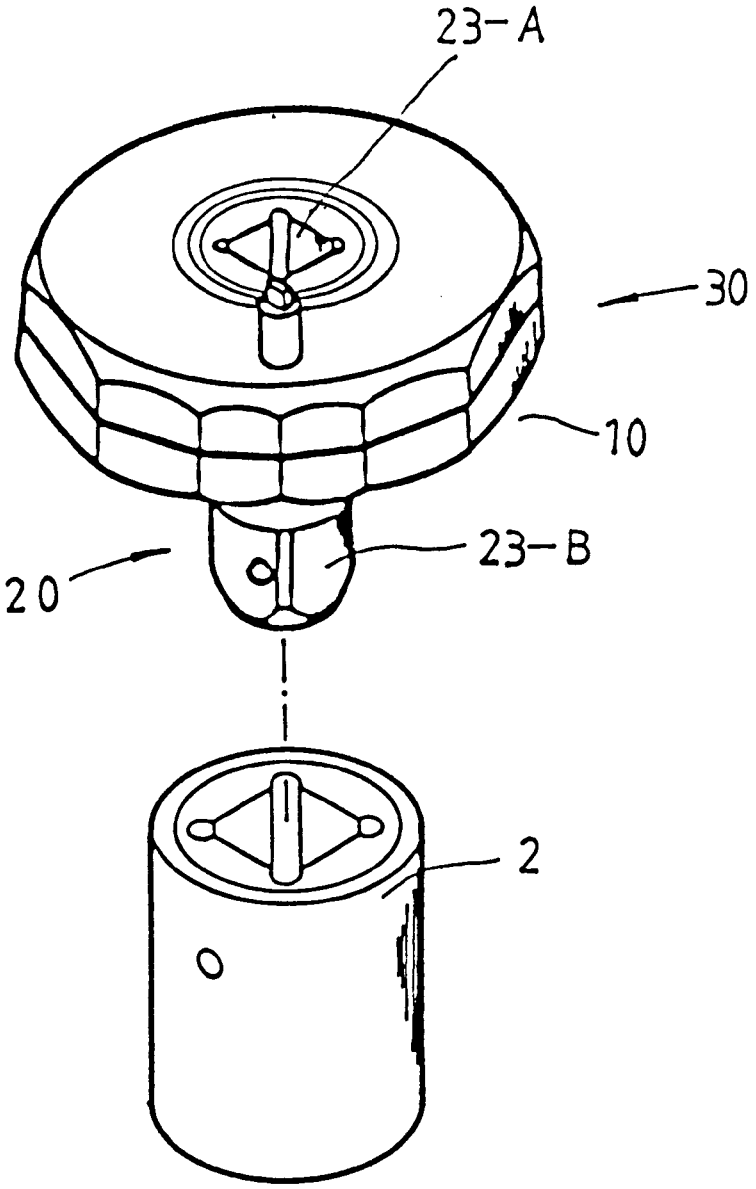
Fig • 7

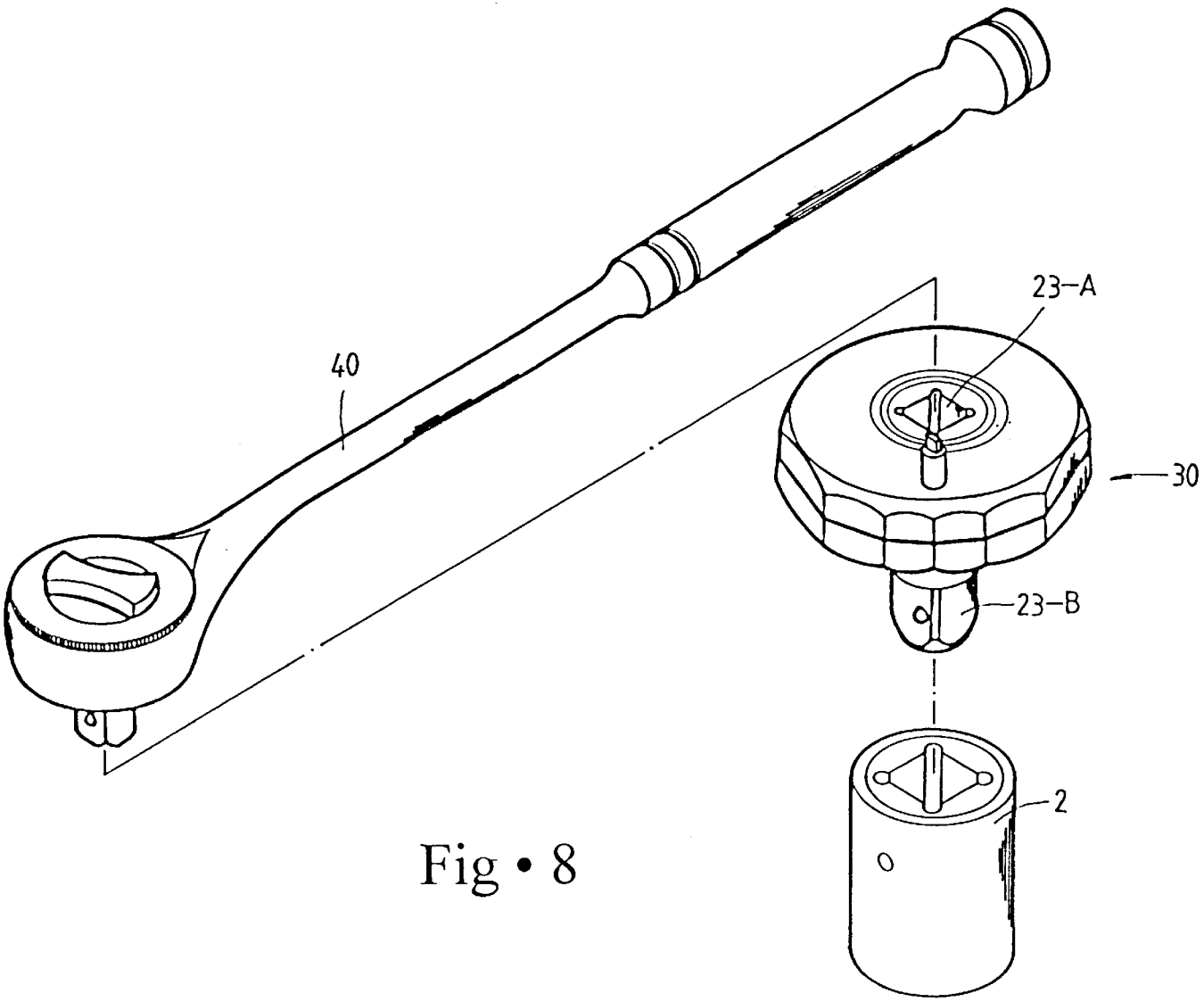
Fig • 8

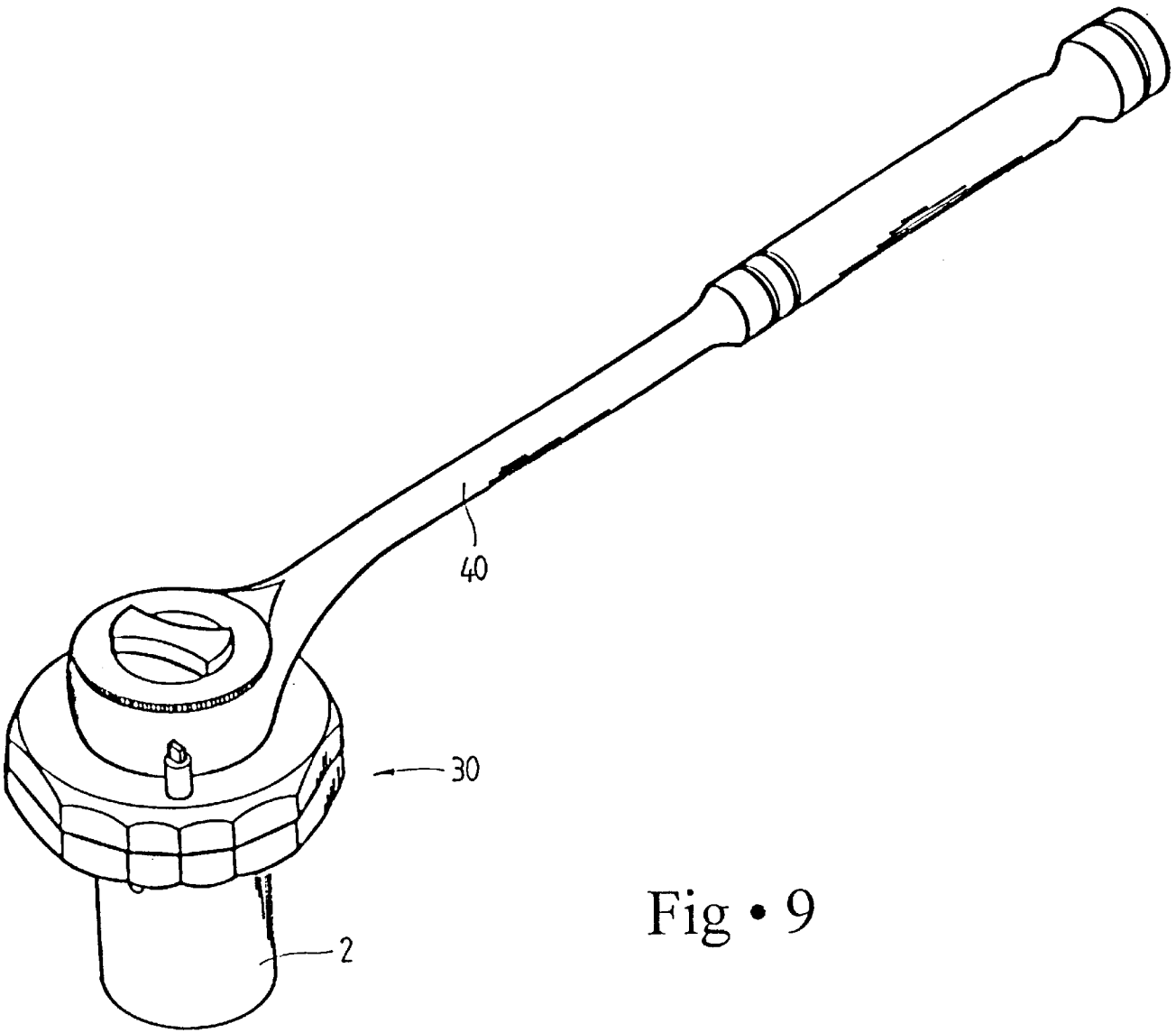
Fig • 9

POLYGONAL RATCHET WRENCH WITH AN ILLUMINATING DEVICE

BACKGROUND OF THE INVENTION (1) Field of the Invention

The invention relates to a polygonal ratchet wrench with an illuminating device, and more particularly to a polygonal ratchet, which is capable of illuminating, bi-directional application and labor-saving.

(2) Description of the Prior Art

Please refer to FIG. 1 for an exploded perspective view of a conventional ratchet wrench 1. The conventional ratchet wrench 1 usually uses a socket 2 to fasten a screw or a nut upon a respective mechanical part. However, the duty of the conventional ratchet wrench 1 is only limited to perform fastening and loosening. In the case that a need exists to fix a machine in an obscure surrounding, an additional lamp or hand torch is required to illuminate the working area so that the conventional ratchet wrench 1 can work properly. Nevertheless, it is usual that the additional illuminating apparatus can not direct to the working position of the wrench 1, so the operation of the wrench 1 is still difficult in such an obscure surrounding. Further, because a hand is occupied by the lamp or hand torch, the application of the wrench 1 and the handling of the screws and nuts can only be done by a single hand, from which the work can be substantially affected.

SUMMARY OF THE INVENTION

Accordingly, it is a primary object of the present invention to provide a polygonal ratchet wrench with an illuminating device, in which the wrench provides a micro switch located at a lower rim thereof for controlling a lamp built at a matching body of the wrench. The lamp is used to illuminate the working position of the wrench for facilitating the wrenching operation.

It is another object of the present invention to provide a polygonal ratchet wrench with an illuminating device, in which a receiving hole on the matching body is provided at the opposing side to the lamp. By providing the receiving hole, an extension bar can be applied to operate the wrench of the present invention for labor saving.

It is a further object of the present invention to provide a polygonal ratchet wrench with an illuminating device, in which an action portion is included to control engagement of a control plate and a ratchet for determining the operation direction of the wrench.

All these objects are achieved by the paper-loading mechanism for a document duplicating machine described below.

BRIEF DESCRIPTION OF THE DRAWINGS

The present invention will now be specified with reference to its preferred embodiment illustrated in the drawings, in which FIG. 1 is an exploded perspective view of a conventional ratchet wrench;

FIG. 2 is an exploded perspective view of a preferred polygonal ratchet wrench with an illuminating device in accordance with the present invention;

FIG. 3 is a perspective assembly view of the polygonal ratchet wrench of FIG. 2;

FIG. 4 is a cross sectional view of the polygonal ratchet wrench of FIG. 3;

FIG. 5 shows insides of the polygonal ratchet wrench of FIG. 3;

FIG. 6 is a bottom view of the polygonal ratchet wrench of FIG. 3;

FIG. 7 shows separately the polygonal ratchet wrench of FIG. 3 and a match socket;

FIG. 8 shows separately the polygonal ratchet wrench of FIG. 3, a match socket and an extension bar; and FIG. 9 shows an assembly view of those parts shown in FIG. 8.

DESCRIPTION OF THE PREFERRED EMBODIMENT

The invention disclosed herein is directed to a polygonal ratchet wrench with an illuminating device. In the following description, numerous details are set forth in order to provide a thorough understanding of the present invention. It will be appreciated by one skilled in the art that variations of these specific details are possible while still achieving the results of the present invention. In other instance. well-known components are not described in detail in order not to unnecessarily obscure the present invention.

Referring now to FIG. 2, the polygonal ratchet wrench 30 of the present invention includes a hollow housing 10 and a matching body 20.

The hollow housing 10 is used to shield therebeneath a hollow base plate 13. The base plate 13 is used to construct two positive leads 11, two negative leads 12 and two batteries 14 for forming a complete set of power supply unit. Close to a middle hole of the base plate 13, a protrusive pivot 13-A and restriction block 13-D with a springed ball 13-C are built at opposing sides. A position block 13-B is further included on the base plate 13 at the outer side of the restriction block 13-D. The pivot 13-A further includes thereof a ratchet 15 as shown for respectively matching with the ball 13-C positioned inside the restriction block 13-B. As shown in FIG. 2, the ratchet 15 can include an action bar 15-A. In addition, a steel block 23 is included at the middle of the matching body 20. The steel block 23 includes a receiving hole 23-A on top thereof and a protrusive head 23-B at bottom thereof. At the upper rim of the steel block 23, a gear portion 23-C is formed to work with the restriction block 13-D for positioning. By providing the receiving hole 23-A, the hollow housing 10 can be placed upon the matching, body 20. According to the present invention, at least a lamp 22 can be installed to a bottom end of the matching body 20. Also, respective lamps 22 can be assigned to both bottom sides of the hollow housing 10. These three lamps 22 at least are connected with aforesaid batteries 14 for illuminating working position of the wrench.

Referring now to FIG. 3, the hollow housing 10 can be sleeved along the matching body 20 for forming a compact wrench 30. A micro switch 24 can be included at the lower rim of the wrench 30 for controlling ON/OFF of the lamps 22. By providing the lamps 22, the working area, particularly the working position, can be properly illustrated so that the wrench 30 can be applied even at a dark surrounding.

Referring now to FIG. 4, the batteries 14 inside the wrench 30 can supply power to the lamps 22 for shining the working position. In particular, the lamp 22 located at the bottom of the matching body 20 can direct along the engaging path of the wrench 30, by which the steel block 23 can smoothly engage with a respective socket 2. The lamps 22 located at the bottom side of the hollow housing 10 can be used to illustrate the working area of the wrench 30, so that both hand can be available to operate the wrenching.

Referring now to FIG. 5, an extension bar 40 can be included to engage with the receiving hole 23-A of the wrench 30 as a whole for extending the force arm upon driving the wrench 30. The head 23-B of the wrench 30 is used to engage with the socket 2. Referring also to FIG. 6, the head 23-B of the wrench 30 can be built directly with the socket 2 for easy application. While in use, application force is applied to the extension bar 40 for rotating the wrench 30. By providing the extension bar 40, much labor can be saved upon applying the wrench 30.

Moreover, the action portion 15-A can be used to alter the meshing between the ratchet 15 and the gear portion 23-C of the matching body 20 for switching the application direction of the wrench 30. By providing such a mesh mechanism, repeatedly removing the wrench 30 from the screws or nuts can be avoided.

While the present invention has been particularly shown and described with reference to a preferred embodiment, it will be understood by those skilled in the art that various changes in form and detail may be without departing from the spirit and scope of the present invention.

I claim:

1. A polygonal ratchet wrench with an illuminating device, comprising a hollow housing and a matching body; the hollow housing having a hollow base plate for constructing thereon two positive leads, two negative leads and two batteries for forming a complete power supply unit; the hollow base plate having thereon at opposing sides a protrusive pivot and a restriction block with a springed ball, and having a position block thereon located outside the restriction block; the pivot having thereof a ratchet for meshing with the sprigged ball located inside the position block, and the ratchet having thereof an action portion; further the matching body having thereof a middle steel block with a top receiving hole and a bottom protrusive head, the steel block having thereof an upper gear portion for positioning with the restriction lock; the hollow housing resting upon the matching body; a bottom of the matching body and a bottom side of the hollow housing having respective lamps energized by the batteries for illumination.

2. The polygonal ratchet wrench with an illuminating device according to claim 1, wherein said hollow housing is formed to sleeve along said matching body.

3. The polygonal ratchet wrench with an illuminating device according to claim 1, wherein said matching body is shaped as a polygonal structure.

4. A polygonal ratchet wrench with an illuminating device, comprising:

a hollow housing;

a hollow base plate located within the hollow housing, the hollow base plate having thereon a complete power supply unit, a protrusive pivot, a restriction block with a springed ball, and a position block, wherein the protrusive pivot has a ratchet for meshing with the sprigged ball, and the ratchet has an action portion;

a matching body having a middle steel block with a top receiving hole and a bottom protrusive head, the middle steel block having an upper gear portion for positioning with the restriction lock, wherein the hollow housing encompasses the matching body, but exposes the top receiving hole and the bottom protrusive head, and the hollow base plate has a center hole for receiving the matching body, and the bottom protrusive head of the matching body and a bottom side of the hollow housing have lamps powered by the power supply unit.

5. The polygonal ratchet wrench with an illuminating device according to claim 4, wherein the protrusive pivot and the restriction block are located at opposing ides of the hollow base plate, and the position block is located outside the restriction block.

6. The polygonal ratchet wrench with an illuminating device according to claim 4, wherein the hollow base plate has a polygonal shape.

* * * * *